US009546652B2

(12) United States Patent
Yin

(10) Patent No.: US 9,546,652 B2
(45) Date of Patent: Jan. 17, 2017

(54) SYSTEM AND METHOD FOR MONITORING AND CONTROL OF CAVITATION IN POSITIVE DISPLACEMENT PUMPS

(75) Inventor: Dan Yin, Waxhaw, NC (US)

(73) Assignee: IMO Industries, Inc., Lawrenceville, NJ (US)

( * ) Notice: Subject to any disclaimer, the term of this patent is extended or adjusted under 35 U.S.C. 154(b) by 1161 days.

(21) Appl. No.: 13/432,625

(22) Filed: Mar. 28, 2012

(65) Prior Publication Data

US 2013/0259707 A1 Oct. 3, 2013

(51) Int. Cl.

| | |
|---|---|
| ***F04B 49/02*** | (2006.01) |
| ***F04B 49/00*** | (2006.01) |
| ***F04B 49/06*** | (2006.01) |
| ***F04B 49/08*** | (2006.01) |
| ***F04C 14/28*** | (2006.01) |

(52) U.S. Cl.

CPC ..... *F04B 49/022* (2013.01); *F04B 49/00* (2013.01); *F04B 49/06* (2013.01); *F04B 49/08* (2013.01); *F04C 14/28* (2013.01); *F04B 2205/01* (2013.01); *F04B 2205/03* (2013.01); *F04B 2205/05* (2013.01); *F04B 2205/07* (2013.01); *F04C 2270/18* (2013.01); *F04C 2270/86* (2013.01)

(58) Field of Classification Search

CPC .. F04D 15/0245; F04D 15/0281; F04D 15/02; F04D 15/0209; F04B 19/12; F04B 49/02; F04B 49/08; F04B 49/03; F04B 49/065; F04C 18/08; F04C 2/08; F04C 2270/215; F04C 2270/40–2270/46; F04C 2270/605; F04C 2270/80; F04C 2270/86; F04C 2270/90

USPC ..... 700/282

See application file for complete search history.

(56) References Cited

U.S. PATENT DOCUMENTS

| | | | | |
|---|---|---|---|---|
| 3,981,618 | A * | 9/1976 | Nelson, Jr. | 417/12 |
| 4,016,898 | A * | 4/1977 | Tokarchuk et al. | 137/115.21 |
| 4,512,722 | A * | 4/1985 | Mouton | 417/63 |

(Continued)

FOREIGN PATENT DOCUMENTS

| | | | |
|---|---|---|---|
| CN | 200940608 | Y | 8/2007 |
| EP | 20655584 | A1 | 6/2009 |

(Continued)

OTHER PUBLICATIONS

Supplementary European Search Report completed Nov. 19, 2015 for EPO Patent Application No. 12872798.

*Primary Examiner* — Devon Kramer
*Assistant Examiner* — Kenneth J Hansen

(57) ABSTRACT

A system and method are disclosed for monitoring and controlling a positive displacement pump using readings obtained from a plurality of pressure sensors. The pressure sensors may be mounted at the suction, discharge and interstage regions of the pump. Signals from the pressure sensors are compared to obtain a ratio that is used to predict whether a cavitation condition exists within the pump. The ratio can be compared to user provided limits to change an operating characteristic of the pump to reduce predicted cavitation. The pump may be stopped, or pump speed changed, when the ratio is less than a predetermined value. In some embodiments, historical information regarding the ratio may be used to obtain standard deviation information which may then be used to predict whether gas bubbles are passing through the pump. Other embodiments are described and claimed.

20 Claims, 6 Drawing Sheets

(56) References Cited

U.S. PATENT DOCUMENTS

| | | | | | |
|---|---|---|---|---|---|
| 4,705,459 | A | * | 11/1987 | Buisine et al. | 417/53 |
| 5,213,477 | A | * | 5/1993 | Watanabe et al. | 417/20 |
| 5,222,867 | A | * | 6/1993 | Walker et al. | 417/12 |
| 5,601,414 | A | | 2/1997 | Dire | |
| 6,033,187 | A | * | 3/2000 | Addie | 417/18 |
| 6,056,008 | A | * | 5/2000 | Adams et al. | 137/487.5 |
| 6,145,332 | A | * | 11/2000 | Hyde | 62/190 |
| 6,655,922 | B1 | * | 12/2003 | Flek | 417/44.1 |
| 6,663,349 | B1 | * | 12/2003 | Discenzo et al. | 417/44.1 |
| 7,558,699 | B2 | * | 7/2009 | Beck et al. | 702/182 |
| 7,637,723 | B2 | * | 12/2009 | Sadasivam | 417/44.1 |
| 8,303,260 | B2 | * | 11/2012 | Stavale et al. | 417/43 |
| 2002/0123856 | A1 | | 9/2002 | Eryurek | |
| 2008/0288115 | A1 | * | 11/2008 | Rusnak et al. | 700/282 |
| 2009/0053072 | A1 | * | 2/2009 | Borgstadt et al. | 417/17 |
| 2010/0143157 | A1 | * | 6/2010 | Ahonen et al. | 417/44.1 |
| 2010/0269574 | A1 | * | 10/2010 | Zeqiri | 73/61.79 |
| 2012/0138272 | A1 | * | 6/2012 | Zimmerman et al. | 165/104.25 |

FOREIGN PATENT DOCUMENTS

| | | | |
|---|---|---|---|
| JP | H05-322714 | A | 12/1993 |
| WO | 2009/024769 | A2 | 2/2009 |

* cited by examiner

SYSTEM AND METHOD FOR MONITORING AND CONTROL OF CAVITATION IN POSITIVE DISPLACEMENT PUMPS

FIELD OF THE DISCLOSURE

The disclosure is generally related to the field of monitoring systems for machinery, and more particularly to an improved system and method for monitoring pump cavitation and for controlling pump operation based on such monitoring.

BACKGROUND OF THE DISCLOSURE

The condition of rotating machinery is often determined using visual inspection techniques performed by experienced operators. Failure modes such as cracking, leaking, corrosion, etc. can often be detected by visual inspection before failure is likely. The use of such manual condition monitoring allows maintenance to be scheduled, or other actions to be taken, to avoid the consequences of failure before the failure occurs. Intervention in the early stages of deterioration is usually much more cost effective than undertaking repairs subsequent to failure.

One downside to manual monitoring is that typically it is only performed periodically. Thus, if an adverse condition arises between inspections, machinery failure can occur. It would be desirable to automate the condition monitoring process to provide a simple and easy-to-use system that provides constant monitoring of one or more machinery conditions. Such a system has the potential to enhance operation, reduce downtime and increase energy efficiency.

SUMMARY OF THE DISCLOSURE

A system is disclosed for monitoring and controlling a positive displacement pump. The system includes a plurality of pressure sensors mounted to a positive displacement pump, and a controller for receiving input signals from the plurality of pressure sensors. The controller can be configured to process the input signals to obtain a cavitation severity ratio. The cavitation severity ratio can be a ratio of the difference between interstage pressure and suction pressure of the pump and the difference between discharge pressure and suction pressure of the pump. The cavitation severity ratio can also be simplified as a ratio of a measured interstage pressure of the pump and a measured discharge pressure of the pump, if the suction pressure level is small (or zero) when compared to the levels of discharge pressure and interstage pressure. The controller can be configured to adjust an operating speed of the pump based on a comparison of the cavitation severity ratio to a predefined application based severity level.

A method is disclosed for monitoring and controlling a positive displacement pump. The method may comprise: obtaining a plurality of signals representative of pressures at a plurality of locations in a positive displacement pump; processing the plurality of signals to obtain a cavitation severity ratio, where the cavitation severity ratio is a ratio of the difference between interstage pressure and suction pressure of the pump and the difference between discharge pressure and suction pressure of the pump; and adjusting an operating speed of the positive displacement pump based on a comparison of the cavitation severity ratio to a predefined application based severity level.

BRIEF DESCRIPTION OF THE DRAWINGS

By way of example, a specific embodiment of the disclosed device will now be described, with reference to the accompanying drawings.

DETAILED DESCRIPTION

In positive displacement screw pumps, pressure is developed from the inlet or suction port of the pump to the outlet or discharge port in stage-to-stage increments. Each stage is defined as a moving-thread closure or isolated volume formed by the meshing of pump rotors between the inlet and outlet ends of the pump. Pressure is developed along the moving-thread closures as liquid progresses through the pump. The number of closures is usually proportional to the desired level of outlet pressure delivered, i.e., the greater the pressure, the greater the number of closures necessary. The closures enable the pump to develop an internal pressure gradient of progressively increasing pressure increments. Properly applied, a rotary axial-screw pump can be used to pump a broad range of fluids, from high-viscosity liquids to relatively light fuels or water/oil emulsions.

When entrained or dissolved gas exist in solution within the pump, the normal progression of pressure gradient development can be disrupted, adversely affecting pump performance. If large quantities of gas become entrained in the pumped liquid, the internal pumping process may become unsteady and the internal pressure gradient can be lost. The pump may also vibrate excessively, leading to noise and excessive wear.

This condition is synonymous with a phenomenon known as "cavitation." Cavitation usually occurs when the pressure of a fluid drops below its vapor pressure, allowing gas to escape from the fluid. When the pump exerts increasing pressure on a gaseous liquid, unstable stage pressures result, leading to collapse of the gas bubbles in the pump's delivery stage.

Traditional cavitation detection has been through the ascertaining of audible noise, reduced flow rate, and/or increased pump vibration. As can be appreciated, by the time these circumstances can be detected, significant changes in pump operations may have occurred. As a result, it can be too late to protect the pump from internal damage. For example, where the pump is unable to develop a normal pressure gradient from suction to discharge, the total developed pressure may occur in or near the last closure. This can upset normal hydrodynamic support of the idler rotors, which can lead to metal-to-metal contact with consequential damage to the pump.

Knowledgeable application and conservative ratings are traditional protection against these conditions. However, when pumping liquids with unpredictable characteristics or uncontrolled gas content, as is often the case, frequent monitoring of pump operations with attendant labor and other costs is required to maintain normal operation. Traditional means of detecting cavitation and other operating instabilities have been found particularly unsuitable where the pump is expected to provide long reliable service at a remote unattended installation, and under extreme environmental conditions.

Figure 1:
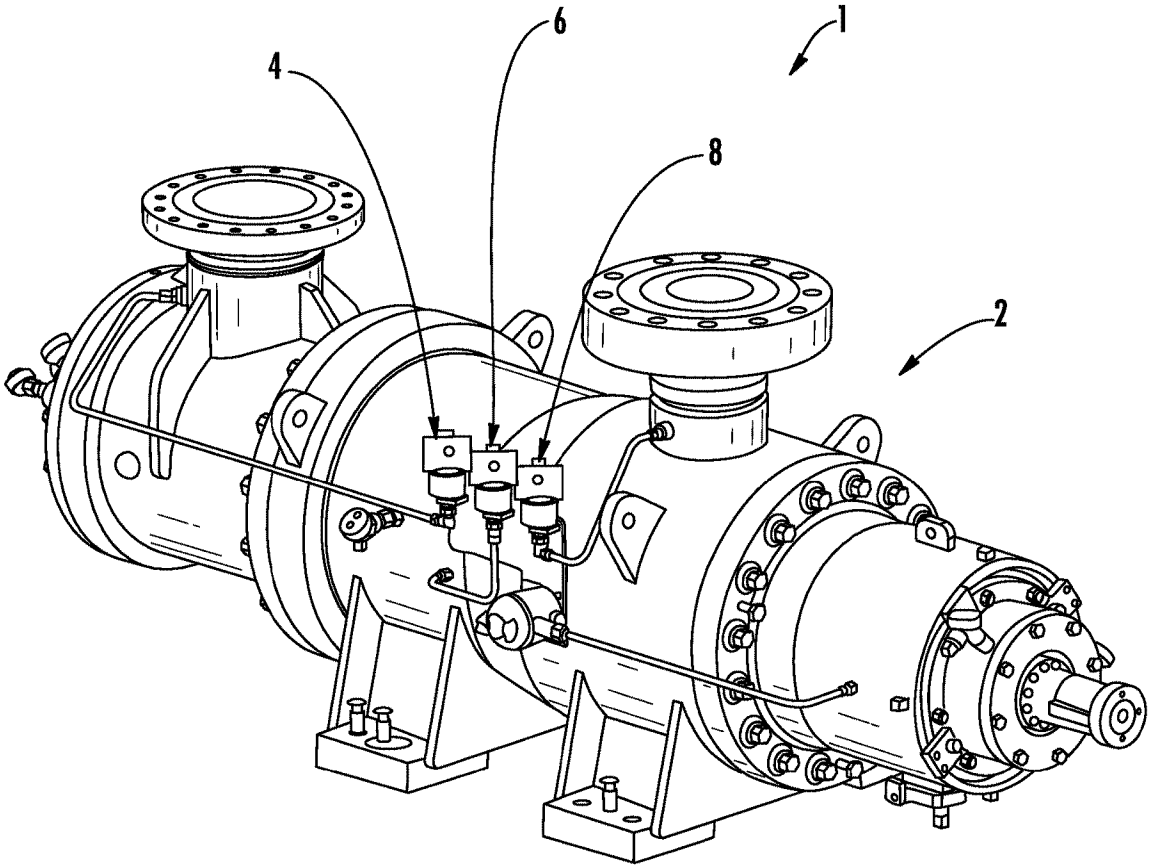
FIG. 1 is an isometric view of an exemplary pump including a plurality of condition monitoring sensors mounted thereon.
Figure 2:
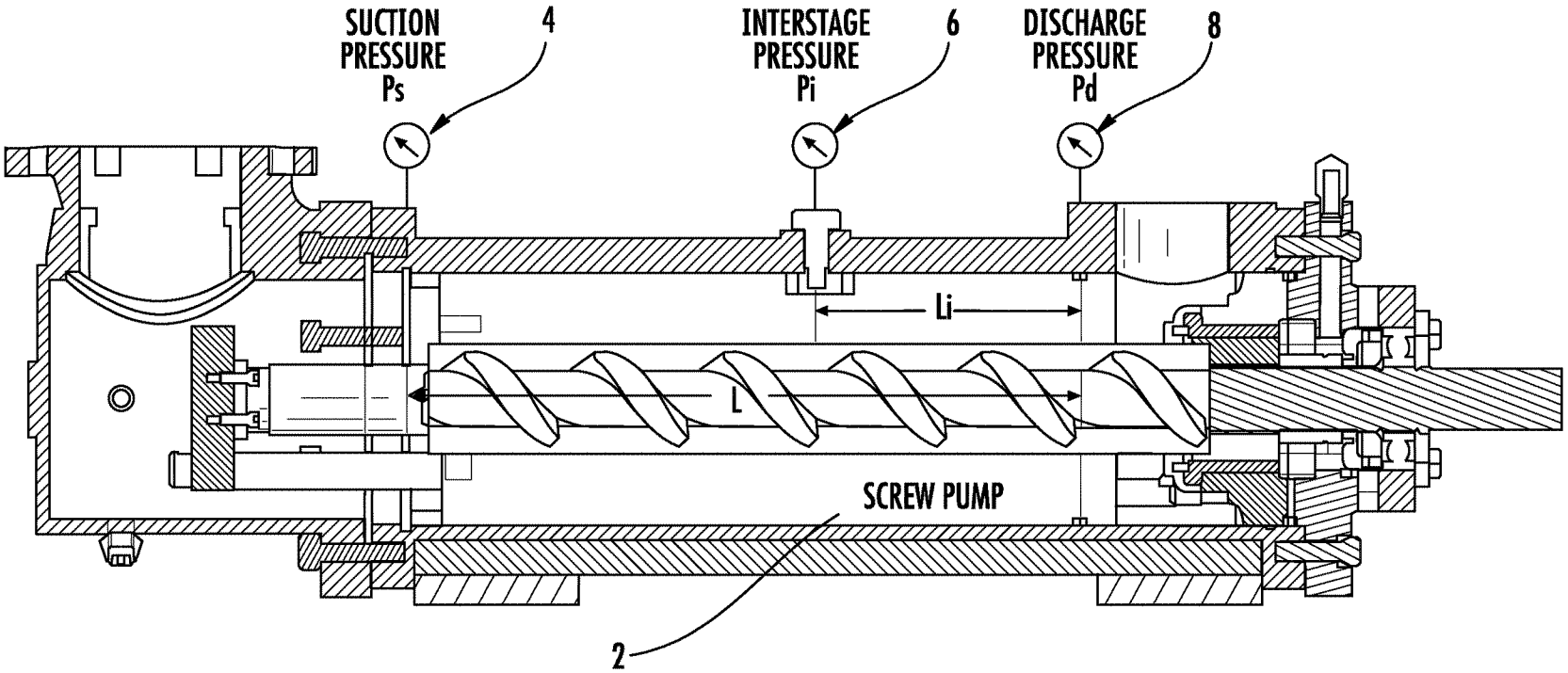
FIG. 2 is a cross-section view of the pump of FIG. 1, taken along line 2-2 of FIG. 1, illustrating the position of the plurality of sensors mounted in relation to the pump's power rotor bore.

Referring now to the drawings, FIGS. 1 and 2 an intelligent cavitation monitoring system 1 mounted to an exemplary pump 2, which in this embodiment is a screw-pump. The system 1 includes a plurality of pressure sensors mounted at appropriate locations throughout the pump 2. These sensors include a suction pressure transducer 4, an interstage pressure transducer 6, and a discharge pressure transducer 8. The suction and discharge pressure sensors 4, 8 are separated by a distance "L" while the suction and interstage pressure sensors 4, 6 are separated by a distance "Li". As will be described in more detail later, the suction pressure sensor 4 can provide a signal representative of the suction pressure "Ps" to the system 1, the interstage pressure sensor can provide a signal representative of an interstage pressure "Pt" to the system 1, and the discharge pressure sensor can provide a signal representative of the discharge pressure "Pd" to the system 1. The system 1, in turn, can employ these signals to determine whether an undesirable cavitation condition exists in the pump 2.

Figure 3:
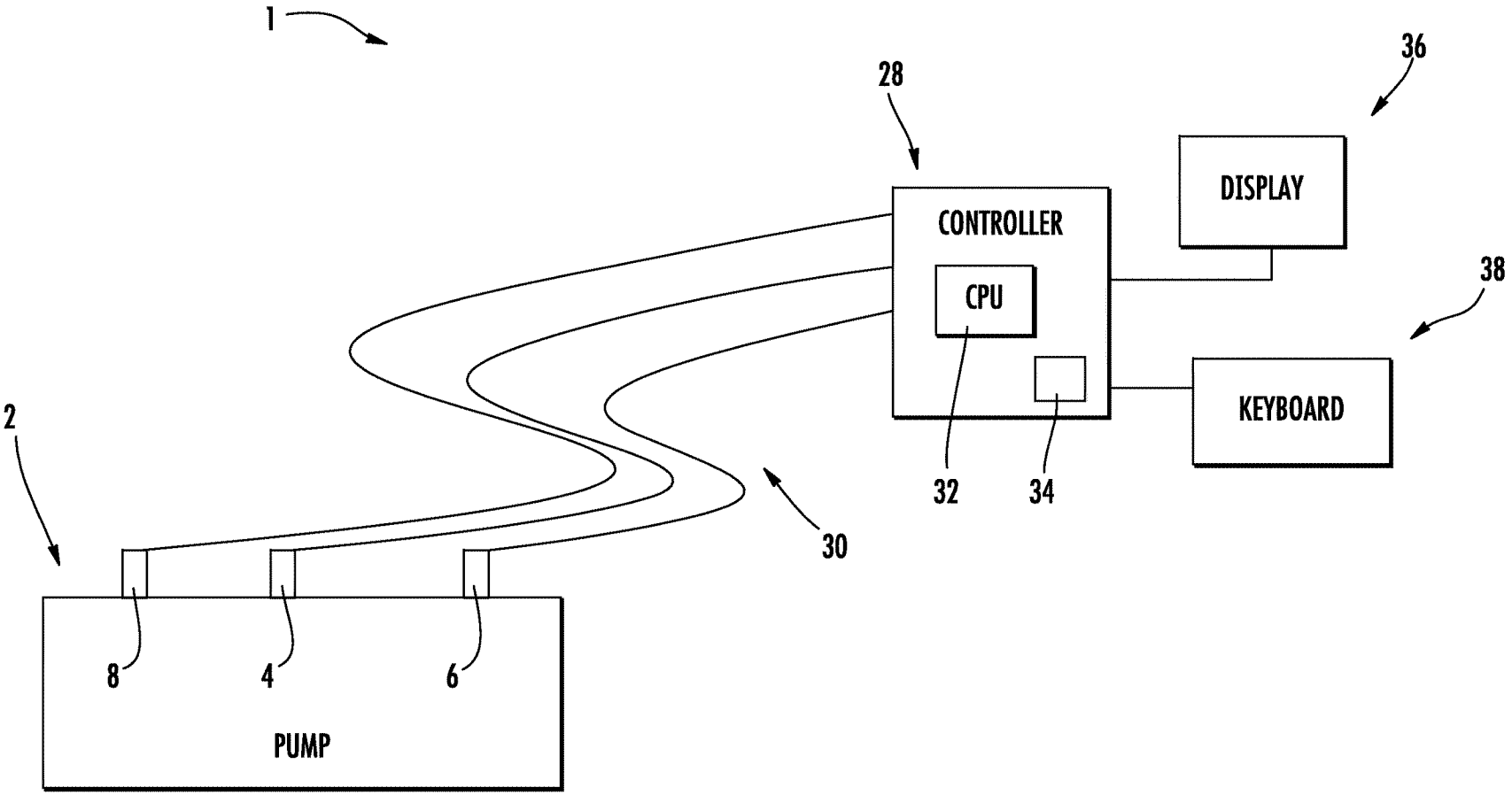
FIG. 3 is a schematic of the disclosed system.

FIG. 3 shows the system 1 including a controller 28 coupled to the pressure sensors 4, 6, 8 via a communications link 30. Thus, the sensors 4, 6, 8 may send signals to controller 28 representative of pressure conditions at multiple locations within the pump 2, as previously noted. The controller 28 may have a processor 32 executing instructions for determining, from the received signals, whether the one or more operating conditions of the pump 2 are within normal or desired limits. A non-volatile memory 34 may be associated with the processor 32 for storing program instructions and/or for storing data received from the sensors. A display 36 may be coupled to the controller 28 for providing local and/or remote display of information relating to the condition of the pump 2. An input device 38, such as a keyboard, may be coupled to the controller 28 to allow a user to interact with the system 1.

The communications link 30 is illustrated as being a hard wired connection. It will be appreciated, however, that the communications link 30 can be any of a variety of wireless or hard-wired connections. For example, the communication link 30 can be a Wi-Fi link, a Bluetooth link, PSTN (Public Switched Telephone Network), a cellular network such as, for example, a GSM (Global System for Mobile Communications) network for SMS and packet voice communication, General Packet Radio Service (GPRS) network for packet data and voice communication, or a wired data network such as, for example, Ethernet/Internet for TCP/IP, VOIP communication, etc.

Communications to and from the controller can be via an integrated server that enables remote access to the controller 28 via the Internet. In addition, data and/or alarms can be transferred thru one or more of e-mail, Internet, Ethernet, RS-232/422/485, CANopen, DeviceNet, Profitbus, RF radio, Telephone land line, cellular network and satellite networks.

As previously noted, the sensors coupled to the pump 2 can be used to measure a wide variety of operational characteristics of the pump. These sensors can output signals to the controller 28 representative of those characteristics, and the controller 28 can process the signals and present outputs to a user. In addition, or alternatively, the output information can be stored locally and/or remotely. This information can be used to track and analyze operational characteristics of the pump over time.

For example, the suction, interstage, and discharge pressure sensors 4, 6, 8 may provide signals to the controller 28 that the controller can use to determine if an undesirable cavitation condition exists at one or more locations within the pump 2. Under normal operation, if a positive displacement pump does not experience cavitation, or does not have excess gas bubbles passing there through, the discharge pressure Pd, interstage pressure Pi and suction pressure Ps will indicate a certain desired pressure gradient at any given time. If, however, the pump experiences undesired cavitation, the desired pressure gradient will not be able to be maintained. In particular, the interstage pressure Pi may decrease. In addition, if excess gas bubbles pass through the pump, the interstage pressure Pi will not only decrease, it will also fluctuate.

If the location of the interstage pressure sensor 6 is located at $L_i$ distance from the location of the suction pressure sensor 4 (see FIG. 2), and the distance between the suction pressure sensor 4 and the discharge pressure sensor 8 is L, then under normal operation conditions the following relationship exists:

$$R = \frac{P_i - P_s}{P_d - P_s} = \frac{L_i}{L} \tag{1}$$

where, as previously noted, Pi is the interstage pressure; Ps is the suction pressure; Pd is the discharge pressure, and R is a ratio that indicates a severity level of cavitation in the pump 2.

Figure 4:
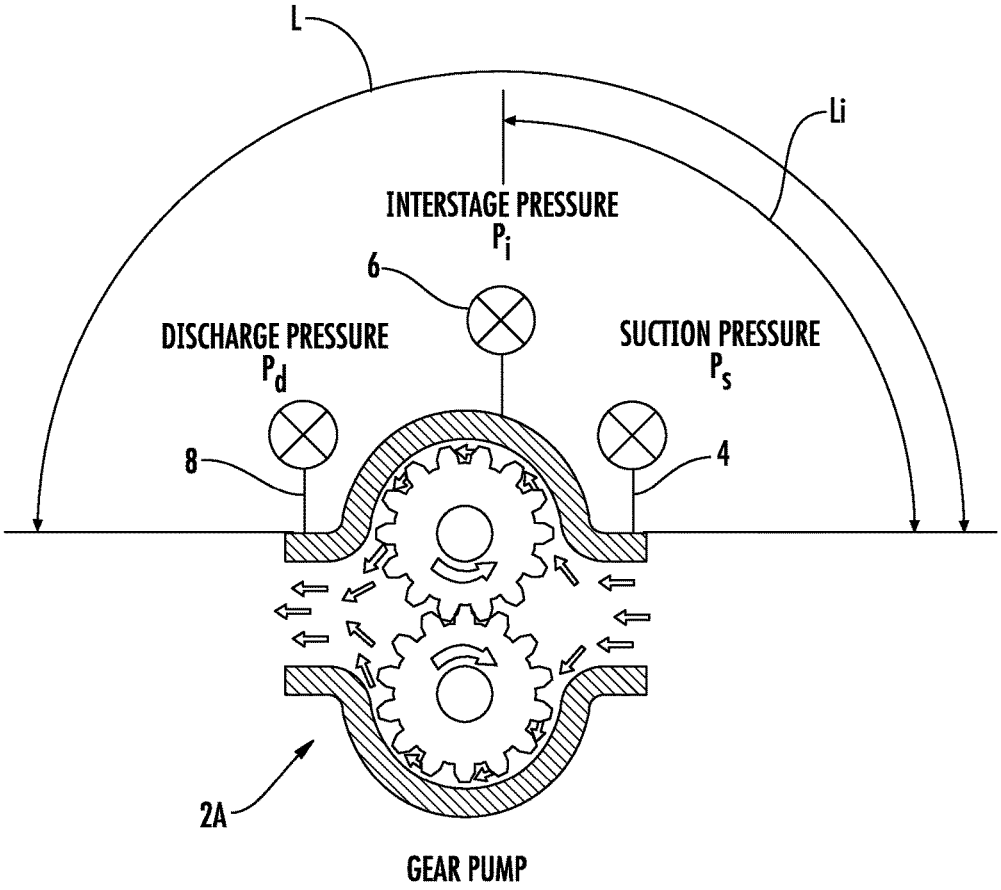
FIG. 4 is a cross-section view of an exemplary positive displacement gear pump.

While FIG. 2 shows the relative locations of the sensors 4, 6, 8 in relation to an exemplary positive displacement screw pump 2, FIG. 4 shows where suction, interstage and discharge pressure sensors 4, 6, 8 may be positioned in an exemplary positive displacement gear pump 2A. In the gear pump 2A embodiment, the interstage pressure sensor 6 may again be located at $L_i$ distance from the location of the suction pressure sensor 4, while the distance between the suction pressure sensor 4 and the discharge pressure sensor 8 may be L. The previously described ratio R again applies as a ratio indicating a severity level of cavitation in the pump 2A. Similar arrangements in other positive displacement pumps can be used such as progressive cavity pumps, (i.e., rotary vane pumps, internal gear pumps, external gear pumps, vane, geared screw pumps).

Once the locations of the pressure measuring components are determined, a target cavitation severity level $R_T$ is also determined, using the following relationship:

$$R_T = \frac{L_i}{L} \tag{2}$$

It will be appreciated that if the interstage pressure sensor 6 is positioned half way between the suction pressure sensor 4 and the discharge pressure sensor 8, then $R_T$ will be 0.5 or 50%. In such a case, when the system is in operation, an actual cavitation severity level $R_a$ can be determined by:

$$R_a = \frac{P_i - P_s}{P_d - P_s} \tag{3}$$

If the suction pressure $P_s$ is assumed to be 0, or if the suction pressure $P_s$ is much smaller than the interstage pressure $P_i$ and the discharge pressure $P_d$, (i.e. 5% or less of the discharge pressure), then the actual cavitation severity level $R_a$ can be simplified to:

$$R_a = \frac{P_i}{P_d} \tag{4}$$

This simplified relationship only utilizes two pressure measuring components, one for measuring discharge pressure (Pd), and the other is used for measuring interstage pressure (Pi).

As previously noted, when a pump 2 cavitates, or gas bubbles pass thru the pump, the pressure gradient between suction and discharge can no longer be maintained, and interstage pressure Pi will always decrease. Therefore, a decreasing actual cavitation severity level $R_a$ will be observed where the cavitation condition continues to deteriorate. The disclosed system 1 enables a user to input an application based cavitation severity level $R_u$, which is smaller than system's target level $R_T$. The actual cavitation severity level $R_a$ is then compared to the application based cavitation severity level $R_u$, and if $R_a$ is determined to be lower than the defined $R_u$ level, the system identifies the cavitation level as being at an unacceptable level for the application. The lower the $R_u$ value, the more severe the cavitation a pump is allowed to experience. In some embodiments, $R_u$ may be selected to be a value that corresponds to a cavitation level that involves no obvious noises and/or vibration.

The system 1 acquires the pressure signals from the sensors 4, 6, 8 and converts them to digital values for further computation. The actual system's cavitation severity ratio $R_a$ can then be calculated according to formula (3) or (4). In some embodiments, multiple samples may be obtained for a given sampling cycle to obtain an average reading to make sure the value is stable and substantially free of the effects of pressure fluctuation caused by gear teeth or screw ridges. The value $R_a$ can then be compared with target level $R_T$ as well as the user input cavitation severity level $R_u$.

In some embodiments, the speed of the pump 2 may be automatically adjusted based on this comparison. Thus, pump speed 2 may be automatically increased or decreased based on the calculated actual severity level $R_a$. For example, if $R_a$ is equal to, or within a predetermined range of, the user's application based severity level $R_u$, then a current operation condition of the pump can be maintained. In some embodiments, this range may be about 5%. This is because even if the severity level indicates that the pump 2 is cavitating, the level of cavitation has been determined by the user to be acceptable for the particular application.

If, however, $R_a$ is determined to be larger than user's application based level $R_u$, the speed of the pump 2 may be increased until $R_a$ is equal to, or within a predetermined range of, the user's application based level $R_u$. Alternatively, if $R_a$ is smaller than user's application based level $R_u$, the speed of the pump may be decreased until $R_a$ is equal to, or within a predetermined range of, the user's application based level $R_u$. In some embodiments, this range may be about 5%.

The user may also choose to change pump speed or to stop the pump 2 based on $R_u$, $R_T$ and the calculated value for $R_a$. For example, the user may configure the system 1 so that the pump is stopped whenever $R_a$ is less than application based level $R_u$. Other predetermined stop levels may also be used.

In some embodiments, an absolute lower limit of the cavitation severity level $R_L$ can be defined in order to prevent the pump from cavitation damage. Thus, $R_L$ may be defined to correspond to a cavitation level at which noise and/or vibration may cause damage to the pump. Thus, the application based severity level $R_u$ will typically be between $R_L$ and $R_T$. As such, whenever calculated actual severity level $R_a$ is below $R_L$, the pump will be stopped to prevent further damage.

The system 1 may store a plurality of historical actual level $R_a$ values in memory 34. A standard deviation $R_{STD}$ of these historical levels can be calculated to determine if changes in the historical levels exceed a certain amount $R_B$. This value $R_B$ can be used as an indicator that gas bubbles are passing through the pump 2. The value of $R_B$ can be user adjustable based on the particular application. In use, if a calculated standard deviation $R_{STD}$ exceeds the predetermined value for $R_B$, the user can choose from a variety of action, increasing pump speed, deceasing pump speed, or stopping the pump.

$R_a$ and other system information can also be sent out for external use, controls, and/or making other decisions. In some embodiments, this information can be used to increase or decrease pump flow rate, or to prompt a user to modify $R_a$ or another system parameter. This data can also be used for long term operational and maintenance trending purposes, which can be used to predict and/or optimize maintenance schedules. The data can also be used to identify fluid characteristic changes or process changes that may be causing the pump to cavitate.

Figure 5:
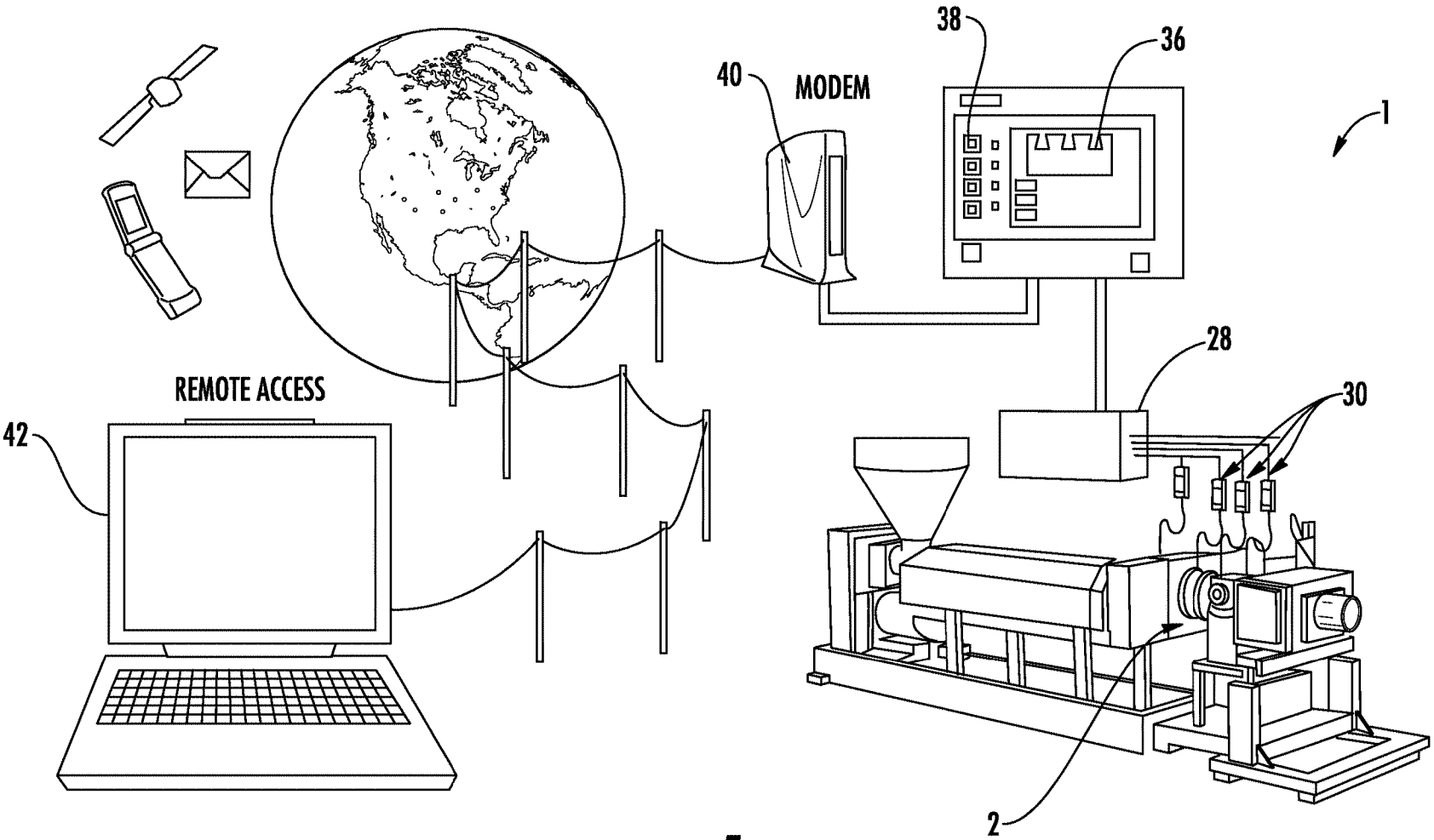
FIG. 5 is a schematic of the system of FIG. 3 expanded to include remote monitoring and control.

FIG. 5 shows an embodiment of the system 1 that facilitates remote access of measured and/or calculated parameters. As shown, the system 1 includes pump 2 with a plurality of sensors coupled to a controller 28 via a plurality of individual communications links 30. The controller 28 includes a local display 36 and keyboard 38. In the illustrated embodiment, the display and keyboard are combined into a touch screen format, which can include one or more "hard" keys, as well as one or more "soft" keys. The controller 28 of this embodiment is coupled to a modem 40 which enables a remote computer 42 to access the controller 28. The remote computer 42 may be used to display identical information to that displayed locally at the controller 28. The modem 40 may enable the controller 28 to promulgate e-mail, text messages, and pager signals to alert a user about the condition of the pump 2 being monitored. In some embodiments, one or more aspect of the operation of the pump 2 may also be controlled via the remote computer 42.

Figure 6:
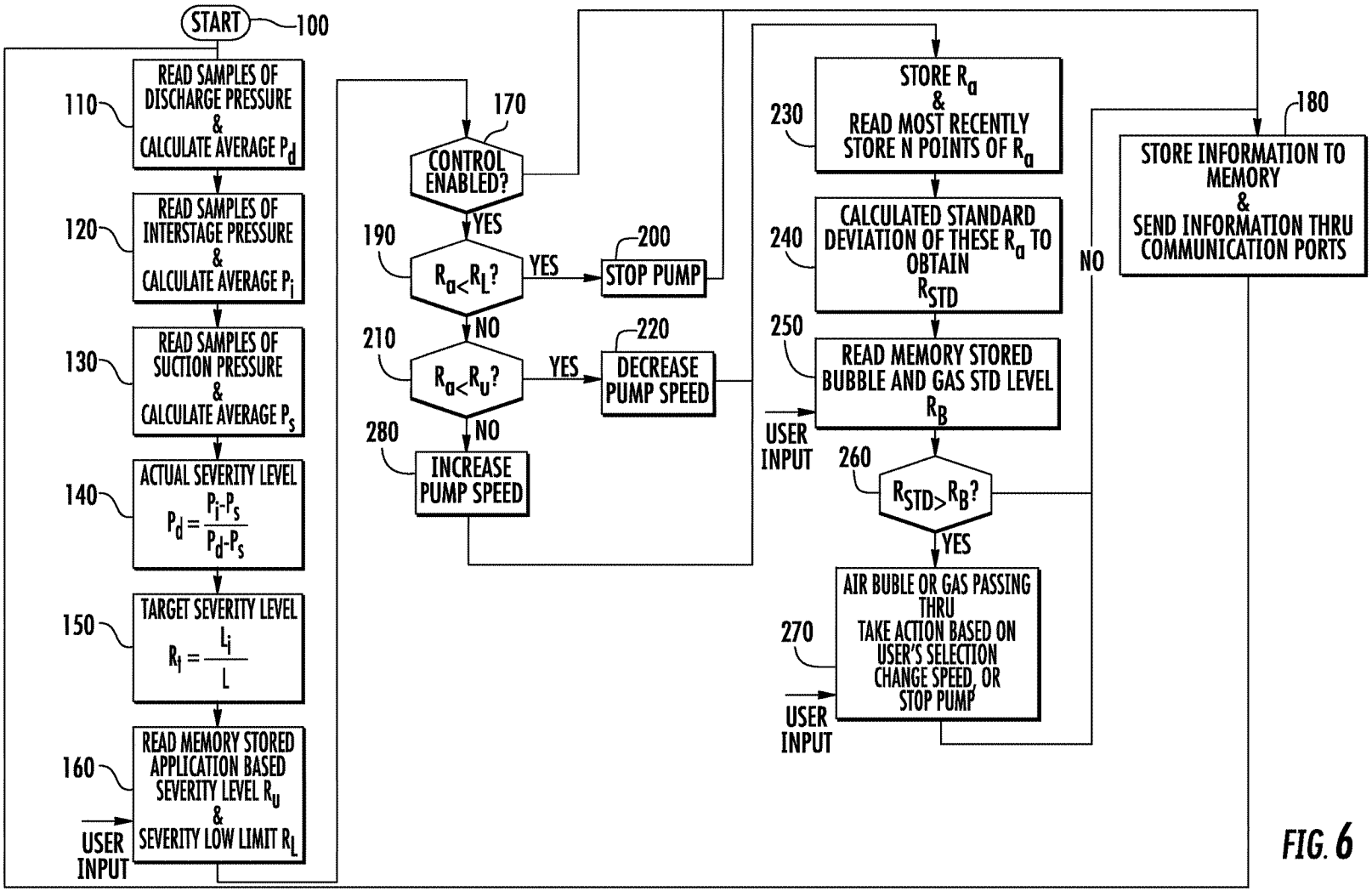
FIG. 6 is an exemplary logic flow illustrating an exemplary method for using the disclosed system.

FIG. 6 illustrates an exemplary logic flow describing a method for monitoring cavitation in a positive displacement pump 2 and for controlling pump operation based on such monitoring. The method begins at step 100. At step 110, a plurality of samples of discharge pressure are obtained, and an average discharge pressure Pd value is determined. The number of samples, or sampling rate, can be determined based on the number teeth (or number of screw ridges) (T) of the pump screw(s) or gears, and an actual operating speed (V) (rpm) of the pump. In some embodiments, the sampling rate is selected to be larger than the frequency of pulses caused by the passing teeth (or screw ridges), which in one embodiment is calculated according to the formula: T*V/60 (Hz). At step 120, a plurality of samples of interstage pressure are obtained, and an average interstage pressure value Pi is determined. At step 130, a plurality of samples of suction pressure are obtained, and an average suction pressure value Ps is determined. At step 140, an actual cavitation severity level $R_a$ is determined. In one embodiment, $R_a$ is determined according to formula (3) or (4). At step 150, a target cavitation severity level $R_T$ is determined. In one embodiment, $R_T$ is determined according to formula (2). At step 160, stored values of an application cavitation severity level $R_u$ and a cavitation severity low limit $R_L$ are read from memory. In one embodiment, $R_u$ and $R_L$ are input by a user depending upon a particular application of the pump. At step 170, a determination is made as to whether control is enabled. When control is enabled, whenever the actual cavitation severity level $R_a$ drops below the application based cavitation severity level $R_u$, the system will change the pump speed, and will then determine whether the cavitation condition improves (i.e., whether $R_a$ raises above $R_u$). Often, the pump speed will be reduced in order to improve the pump operation. When control is not enabled, the system will simply generate alarms when the actual cavitation severity level $R_a$ drops below the application based cavitation severity level $R_u$. If control is not enabled, then at step 180, the sampled and calculated values from steps 110-150 are stored in memory and are sent through communication ports for alarm notification purposes. The method then returns to step 110. If control is determined to be enabled, then at step 190, a determination is made as to whether $R_a$ is less than $R_L$. If $R_a$ is less than $R_L$, then at step 200 the pump 2 is stopped. The method then proceeds to step 180, where the sampled and calculated values from steps 110-150 are stored in memory and are sent through communication ports. The method then returns to step 110. If, however, at step 190 it is determined that $R_a$ is not less than $R_L$, then at step 210 a determination is made as to whether $R_a$ is less than $R_u$. If $R_a$ is less than $R_u$, then at step 220, pump operating speed is decreased. The rate of the speed reduction can be predetermined and/or adjustable by the user, and at the next iteration of the control loop, the system will repeat the evaluation. At step 230, the value of $R_a$ is stored in memory, and a number "N" of most recently stored values of $R_a$ are read from memory. In one embodiment, the number "N" is determined according to the formula: T*V/60, where "T" is the number of pump screw teeth or ridges, and "V" is the operating speed of the pump in RPM. At step 240, a standard deviation of the read values of $R_a$ is calculated to determine Rstd. At step 250, a stored value of bubble and gas standard level $R_B$ is read from memory. In one embodiment, the value of $R_B$ is input by a user depending upon a particular application of the pump. At step 260, a determination is made as to whether $R_{STD}$ is greater than $R_B$. If it is determined that $R_{STD}$ is not greater than $R_B$, then the method proceeds to step 180, where the sampled and calculated values from steps 110-150, and 230-250 are stored in memory and are also sent through communication ports. The method then returns to step 110. If, however, at step 260 it is determined that $R_{STD}$ is not greater than $R_B$, then at step 270 air or gas bubbles are determined to be passing through the pump, and an operational characteristic of the pump is automatically adjusted. The operational characteristic can include changing pump speed or stopping the pump. The method then proceeds to step 180, where the sampled and calculated values from steps 110-150, and 230-250 are stored in memory and are also sent through communication ports. The method then returns to step 110. If, at step 210, it is determined that Ra is not less than $R_u$, then at step 280, pump operating speed is increased. The method then proceeds to step 230 in the manner previously described.

Some embodiments of the disclosed device may be implemented, for example, using a storage medium, a computer-readable medium or an article of manufacture which may store an instruction or a set of instructions that, if executed by a machine, may cause the machine to perform a method and/or operations in accordance with embodiments of the disclosure. Such a machine may include, for example, any suitable processing platform, computing platform, computing device, processing device, computing system, processing system, computer, processor, or the like, and may be implemented using any suitable combination of hardware and/or software. The computer-readable medium or article may include, for example, any suitable type of memory unit, memory device, memory article, memory medium, storage device, storage article, storage medium and/or storage unit, for example, memory (including non-transitory memory), removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A system for monitoring and controlling a positive displacement pump, comprising:

a plurality of pressure sensors mounted to the positive displacement pump, the plurality of pressure sensors comprising at least first, second and third pressure sensors, wherein the first pressure sensor is separated from the second pressure sensor by a first distance and the first pressure sensor is separated from the third pressure sensor by a second distance; and a controller for receiving input signals from the plurality of pressure sensors, and for processing said input signals to obtain a cavitation severity ratio, the cavitation severity ratio comprising a ratio of the difference between a measured interstage pressure of the pump and a measured suction pressure of the pump and the difference between a measured discharge pressure of the pump and the measured suction pressure of the pump; the controller further configured to adjust an operating speed of the pump based on a comparison of the cavitation severity ratio to a predefined application based severity level and a target cavitation severity level, the application based severity level being set by a user and the target cavitation severity level being based on a ratio between the first distance and the second distance.

2. The system of claim 1, wherein when the cavitation severity ratio is within a predetermined range of the application based severity level, the operating speed of the pump is maintained.

3. The system of claim 1, wherein when the cavitation severity ratio is greater than the application based severity level, the operating speed of the pump is increased until the cavitation severity ratio is within a predetermined range of the application based severity level.

4. The system of claim 1, wherein when the cavitation severity ratio is less than the application based severity level, the operating speed of the pump is decreased until the cavitation severity ratio is within a predetermined range of the application based severity level.

5. The system of claim 1, wherein when the cavitation severity ratio is less than the application based severity level limit, the pump is stopped.

6. The system of claim 1, wherein the cavitation severity ratio Ra is obtained according to the formula:

$$R_a = \frac{P_i - P_s}{P_d - P_s}$$

where Pi is the measured interstage pressure of the pump, Ps is the measured suction pressure of the pump, and Pd is the measured discharge pressure of the pump.

7. The system of claim 1, wherein a simplified cavitation severity ratio Ra is obtained according to the formula:

$$R_a = \frac{P_i}{P_d}$$

when the suction pressure is zero or much smaller than Pi and Pd; and where Pi is the measured interstage pressure of the pump, and Pd is the measured discharge pressure of the pump.

8. The system of claim 1, wherein the controller is further configured to store a plurality of discrete values of cavitation severity ratio over time, and to obtain a standard deviation of the plurality of discrete values to determine if a change in the plurality of discrete values exceeds a predetermined limit.

9. The system of claim 8, wherein when the change in the plurality of discrete values exceeds the predetermined limit, the controller is configured to provide an indication to a user that gas bubbles are present in a pump cavity.

10. The system of claim 9, wherein in response to the indication, the controller is configured to receive a user input to change an operating condition of the pump.

11. A method for monitoring and controlling a positive displacement pump, comprising:

obtaining a plurality of signals representative of pressures at a plurality of locations in the positive displacement pump;

processing the plurality of signals to obtain a cavitation severity ratio, the cavitation severity ratio comprising a ratio of the difference between a measured interstage pressure of the pump and a measured suction pressure of the pump and the difference between a measured discharge pressure of the pump and the measured suction pressure of the pump; and adjusting an operating speed of the positive displacement pump based on a comparison of the cavitation severity ratio to a predefined application based severity level and a target cavitation severity level, the application based severity level being set by a user and the target cavitation severity level being based on a ratio of distances between the plurality of locations.

12. The method of claim 11, further comprising maintaining the operating speed of the pump when the cavitation severity ratio is within a predetermined range of the application based severity level.

13. The method of claim 11, wherein when the cavitation severity ratio is greater than the application based severity level, the method comprises increasing the operating speed of the pump until the cavitation severity ratio is within a predetermined range of the application based severity level.

14. The method of claim 11, wherein when the cavitation severity ratio is less than the application based severity level, the method comprises decreasing the operating speed of the pump until the cavitation severity ratio is within a predetermined range of the application based severity level.

15. The method of claim 11, wherein when the cavitation severity ratio is less than the application based severity limit, the method comprises stopping the pump.

16. The method of claim 11, comprising determining the cavitation severity ratio (Ra) according to the formula:

$$R_a = \frac{P_i - P_s}{P_d - P_s}$$

where Pi is the measured interstage pressure of the pump, Ps is the measured suction pressure of the pump, and Pd is the measured discharge pressure of the pump.

17. The method of claim 11, comprising determining a simplified cavitation severity ratio Ra according to the formula:

$$R_a = \frac{P_i}{P_d}$$

when the suction pressure is zero or substantially smaller than Pi and Pd; and where Pi is the measured interstage pressure of the pump, and Pd is the measured discharge pressure of the pump.

18. The method of claim 11, further comprising storing a plurality of discrete values of cavitation severity ratio over time, and obtaining a standard deviation of the plurality of discrete values to determine if a change in the plurality of discrete values exceeds a predetermined limit.

19. The method of claim 18, wherein when the change in the plurality of discrete values exceeds the predetermined limit, the method comprises providing an indication to a user that gas bubbles are present in a pump cavity.

20. The method of claim 19, wherein in response to the indication, the method comprises receiving a user input to change an operating condition of the pump.

* * * * *